US007491012B2

(12) United States Patent
Weiser

(10) Patent No.: US 7,491,012 B2
(45) Date of Patent: Feb. 17, 2009

(54) ROAD FINISHER

(75) Inventor: Ralf Weiser, Ladenburg (DE)

(73) Assignee: Joseph Voegele AG, Mannheim (DE)

( * ) Notice: Subject to any disclaimer, the term of this patent is extended or adjusted under 35 U.S.C. 154(b) by 0 days.

(21) Appl. No.: 11/833,307

(22) Filed: Aug. 3, 2007

(65) Prior Publication Data

US 2008/0219767 A1 Sep. 11, 2008

(30) Foreign Application Priority Data

Mar. 6, 2007 (DE) ..... 20 2007 003 326 U

(51) Int. Cl.
*E01C 19/00* (2006.01)

(52) U.S. Cl. ..... 404/108

(58) Field of Classification Search ..... 181/204, 181/212, 227, 228, 247, 253; 404/101, 108, 404/110

See application file for complete search history.

(56) References Cited

U.S. PATENT DOCUMENTS 2,573,474 A * 10/1951 Marx ..... 184/47
3,804,079 A * 4/1974 Schrader ..... 126/343.5 A
4,819,428 A * 4/1989 Ciccarone ..... 60/323
5,443,325 A * 8/1995 Simonelli et al. ..... 404/75
5,938,371 A * 8/1999 Gustin et al. ..... 404/108
6,598,390 B2 * 7/2003 Chang ..... 60/323
6,802,387 B1 * 10/2004 Kreger et al. ..... 181/228
6,832,872 B2 12/2004 Koelm et al.
7,207,172 B2 * 4/2007 Willix et al. ..... 60/317

FOREIGN PATENT DOCUMENTS

EP 666373 8/1995
EP 843044 5/1998

* cited by examiner

*Primary Examiner*—Gary S Hartmann
(74) *Attorney, Agent, or Firm*—Darby & Darby PC

(57) ABSTRACT

A road finisher with an internal combustion engine and an engine exhaust pipe has a muffler with an enlarged diameter with respect to that of the engine exhaust pipe, and a pipe for discharging emissions of a building material. The emissions pipe passes though the muffler mounted to the muffler without discharging into the muffler and the exhaust pipe output is supplied to the muffler interior and the muffler has a discharge pipe for the engine exhaust gases.

13 Claims, 2 Drawing Sheets

ROAD FINISHER

FIELD OF THE INVENTION

The invention relates to a road finisher of the type illustrated in the preamble of claim 1.

BACKGROUND OF THE INVENTION

Such a road finisher is known from EP 843 044. The known road finisher is provided with a suction device which sucks off the emissions discharged by the building material, concentrates the same at one location and discharges them to the surrounding area where they do not annoy the operators and persons in the surrounding area. To this end, the known road finisher contains discharge channels that extend from the suction device upwards beyond the driver's seat and possibly beyond further work places for operators and discharge the emissions from this point to the air. Such an arrangement of discharge channels, however, has a relative complex construction as a plurality of fixing elements have to be provided to support the discharge channels safely from vibrations which means increased manufacture as well as assembly efforts.

From U.S. Pat. No. 6,832,872, an exhaust system for road finishers is known in which exhaust gases from the internal combustion engine and emissions from the building material are discharged via a common exhaust port. Upstream of the exhaust port, there is a mixing chamber where the sucked off emissions and the engine exhaust gases are mixed. The purpose of this arrangement is to change the magnitude of the exhaust pulses to achieve noise reduction. The mixing chamber, the engine exhaust pipe and the exhaust port essentially have the same diameter, so that here noise reduction is not achieved by an increase in diameter but by mixing in the emissions.

EP 666 373 describes a road finisher with a suction device for emissions of the building material, wherein the sucked off emissions are passed through an air cleaner which passes a portion of the emissions into the air intake pipe for the internal combustion engine. A further portion of the emissions is directly passed into the exhaust system of the internal combustion engine via a hose pipe downstream of the muffler and is discharged to the air together with the exhaust gas. However, this constructive solution is also discontenting as the hose is freely suspended in the air and can be vigorously moved, for example by the influence of wind, or requires the same complex fixing elements as already described above.

BRIEF DESCRIPTION OF THE INVENTION

The object underlying the invention is to simplify a road finisher with suction device as to the construction and with respect to the assembly efforts.

With the embodiment according to the invention, the muffler that is anyway present in the exhaust pipe and by usual means acts by an increase in diameter is simultaneously used as mounting for the emission pipe, which on the one hand drastically reduces the assembly efforts and on the other hand combines the two exhaust pipes to form one unit defining one single place of discharge. It has been surprisingly found that the passage of the emission pipe through the muffler does not reduce the efficacy of the muffler with respect to noise reduction.

BRIEF DESCRIPTION OF THE DRAWINGS

In the following, one embodiment of the invention is illustrated more in detail with reference to the drawings. In the drawings.

DETAILED DESCRIPTION OF THE INVENTION

Figure 1:
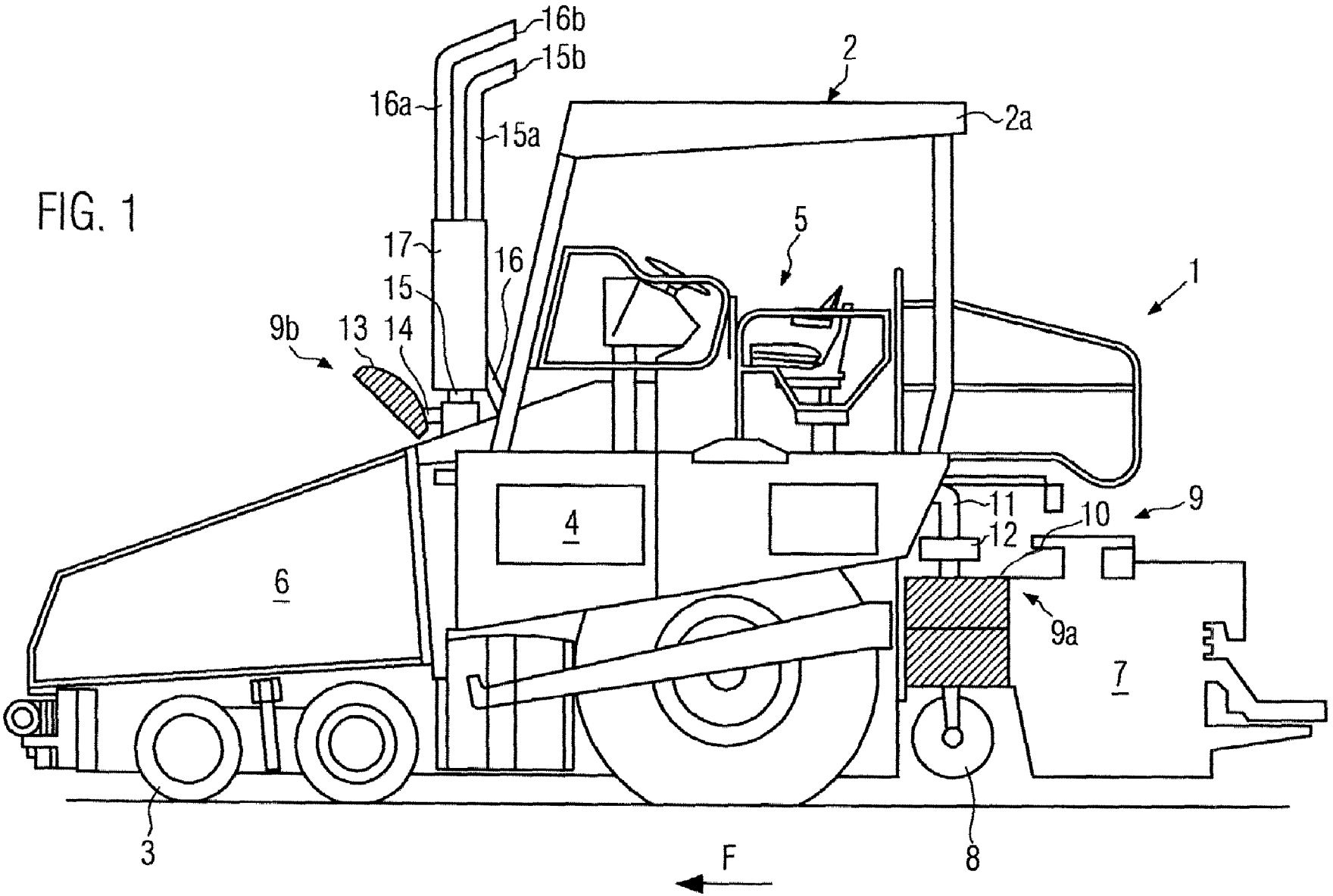
FIG. 1 shows a schematic representation of a road finisher according to the invention.

FIG. 1 shows a schematic representation of an exemplified road finisher 1 which can be of any known construction. The meaning of the term "road finisher" is herein broad and the term relates to any road making machine driven by an internal combustion engine and processing building material that discharges emissions.

The road finisher 1 is designed for applying a bituminous or bitumen-containing surface cover onto a traffic area. The road finisher 1 comprises a chassis 2 running automotively, i.e. by means of an internal combustion engine 4, on an undercarriage 3 (wheels or crawlers) into the direction of motion F (direction of fitting). The road finisher 1 contains a work place 5 for the driver and the facilities usually provided in road finishers, that means for example a bunker 6 for hot bituminous building material located in front of the work place 5 in the direction of motion F, and a building beam 7 which is trailed behind the work place 5 in the direction of motion F. The building material taken from the bunker 6 and transported to the rear in a manner not shown is placed in front of a building worm or another lateral distributor 8 and thereby uniformly distributed across the direction of motion F and placed in front of the building beam 7. In particular in the area of the cross conveyor 8 it cannot be avoided that emissions of the hot building material, for example bitumen aerosols, reach the surrounding area. Although these emissions are not detrimental to health according to present knowledge they are annoying, in particular for operators exposed to them throughout the day. To this end, a suction device 9 for sucking in the emissions is provided. In the represented embodiment, the suction device 9 contains a first suction means 9*a* in the area of the cross conveyor 8. The suction means 9*a* is preferably designed as cover 10 extending along the whole cross conveyor 8 and covering the same at least towards the top. The cover 10 collects the emissions and discharges them via an emission pipe 11. The discharge of the emissions is preferably supported by a suck-and-blow aggregate 12 which can, for example, contain an electrically or hydraulically driven turbine.

In the represented embodiment, the suction device 9 contains a second suction means 9*b* which collects and removes the emissions possibly exiting from the bunker 6. The second suction means 9*b* in turn contains a suction hood 13 preferably extending over the width of the bunker 6, which sucks off the emissions and removes them via an emission pipe 14, preferably again supported by a non-depicted suck-and-blow aggregate.

The two emission pipes 11 and 14 of the two suction means 9*a*, 9*b* are combined in a common emission pipe 15.

The internal combustion engine 4, for example a diesel generator, contains an exhaust system with an engine exhaust pipe 16 ending in one of the common mufflers (exhaust muffler) 17. The muffler 17 has a sound absorbing effect by an increase in the diameter between the engine exhaust pipe 16 and the interior of the muffler 17.

Figure 4:
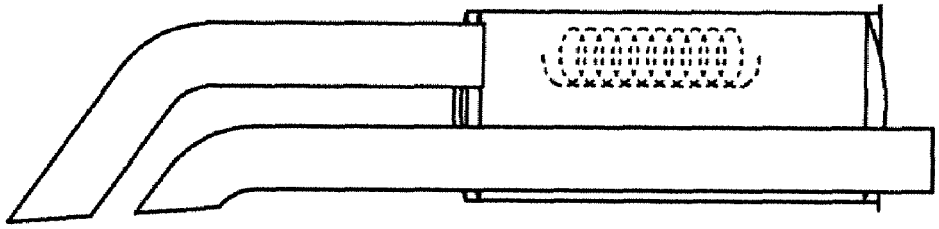
FIG. 4 shows the section IV-IV of FIG. 3.
Figure 3:
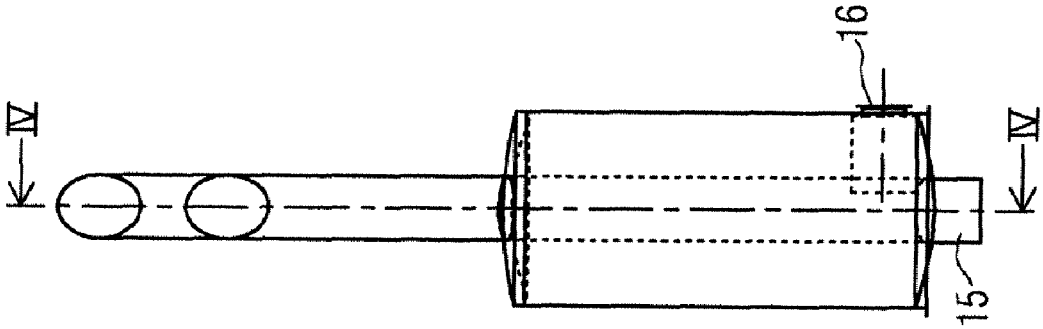
FIG. 3 shows the front view of FIG. 2.
Figure 2:
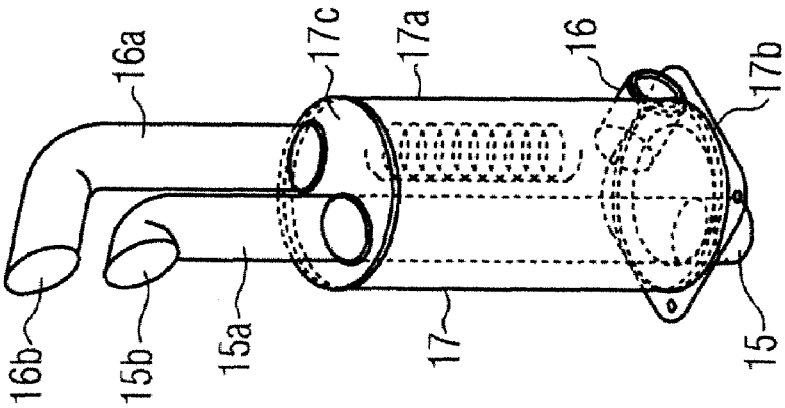
FIG. 2 shows a perspective representation of a muffler designed according to the invention.

As is in particular represented in FIGS. 2 to 4, the muffler 17 contains a case 17*a* which can be cylindrical, cuboid-shaped or have any other cross-section. The case 17*a* is arranged with an essentially perpendicular centre line and closed by a lower cover 17*b* and an upper cover 17*c* to the top and bottom. In the represented embodiment, the covers 17*b* and 17*c* are designed as essentially circular disks and extend perpendicularly and transversely to the centre line of the case 17*a*. The covers, however, can also have a conical or pyramidal or similar design and/or be integrally connected with the case and cause a closure of the muffler by bending.

The emission pipe 15 is designed as tube with a closed wall and an essentially constant cross-section and enters in the lower area of the muffler 17, preferably by penetration of the lower cover 17*b*, the interior of the muffler 17 enclosed by the case 17*a* and passes through the muffler 17 from the bottom to the top without flow communication with the interior of the muffler 17. Subsequently, the emission pipe 15 exits again from the muffler 17 in the upper area, preferably by penetrating the upper cover 17*c*. Above the muffler 17, the emission pipe 15 is continued with an outlet area 15*a* ending in an outlet port 15*b*.

The muffler 17 is designed as mounting for the emission pipe 15, preferably the lower cover 17*b* and/or the upper cover 17*c* holding the emission pipe 15. The mounting can be effected by penetration openings in the muffler 17 adapted to the dimensions of the outer periphery of the emission pipe 15. Preferably, the emission pipe 15 is welded to the muffler 17 which is advantageously made in the area of the penetration openings, i.e. the lower and/or upper covers 17*b*, 17*c*. By this mounting, no further fixing, for example by pipe clamps, connection webs, clamps or the like, are required in the area of the muffler 17 and the outlet area 15*a*, as is shown in the figures.

The exhaust pipe 16 of the exhaust system also ends in the lower area of the muffler 17. The exhaust pipe 16 can, as FIG. 2 shows, be arranged diagonally to the centre line of the case 17*a* or, as shows FIG. 3, perpendicularly to the centre line of the case 17*a*. The engine exhaust gases penetrate the muffler pot, expand whereby silencing is achieved, and exit from the muffler 17 in the upper area via an outlet area 16*a* ending in an exhaust port 16*b* without mixing with the emissions. The engine exhaust pipe 16 and its outlet area 16*a*, too, are preferably welded to the muffler.

The emission pipe 15 and the engine exhaust pipe 16 in the area of the outlet area 16*a* are arranged in essentially parallel centre lines, wherein the centre lines of the pipes 15, 16*a* extend essentially in parallel to the centre line of the muffler 17, and the centre lines of the emission pipe 15 are located in a common plane with the outlet area 15*a* of the outlet area 16*a* and the muffler 17. As is in particular shown in FIG. 1, the outlet areas 15*a*, 16*a* are arranged one behind the other in the direction of motion F, so that the visual range of the ranged one behind the other in the direction of motion F, so that the visual range of the driver from the work place 5 is not affected by the second pipe 15 if the exhaust system is arranged diagonally laterally in front of the work place 5. Moreover, the muffler 17 is neither or only insignificantly enlarged, so that here neither any visual restriction of the driver has to be feared.

Furthermore, the outlets 15*b*, 16*b* are directed backwards in the direction of motion F and over the chassis 2 (for example a roof 2*a* over the work place 5), however, they can also be directed to the front.

In variation to the described and drawn embodiment, the muffler with the two exhaust pipes can also be arranged at other appropriate locations of the finisher 1. Additional suction means or only suction means can be provided at particularly exposed locations. The two exhaust pipes can also have another cross-section.

The invention claimed is:

1. Road finisher having an internal combustion engine and a source of a hot road building material that has emissions comprising:

an engine exhaust pipe coupled to the engine;

a suction device for sucking in emissions of the road building material from the source of materials;

a muffler having an enlarged diameter with respect to that of the engine exhaust pipe with the outlet of the exhaust pipe being coupled to the interior of the muffler; and a pipe for discharging emissions of the building material, wherein the emission pipe is passed through the muffler without the emissions mixing in the muffler interior and the emission pipe is mounted to the muffler.

2. Road finisher according to claim 1, wherein the emission pipe extends with its centre line in parallel to a centre line of the muffler.

3. Road finisher according to claim 1, wherein an inlet area of the engine exhaust pipe extends with its centre line at an angle to a centre line of the muffler.

4. Road finisher according to claim 1, wherein an outlet area of the engine exhaust pipe exits from the muffler in parallel to a centre line of the muffler.

5. Road finisher according to claim 1, wherein the muffler comprises a lower cover to which the emission pipe is mounted.

6. Road finisher according to claim 5, wherein the emission pipe is welded into the lower cover.

7. Road finisher according to claim 1, wherein the muffler comprises an upper cover to which the emission pipe is mounted.

8. Road finisher according to claim 7, wherein the emission pipe is welded into the upper cover.

9. Road finisher according to claim 1, wherein the emission pipe projects with an outlet area upwards beyond the muffler.

10. Road finisher according to claim 1, wherein the muffler has an exhaust pipe that projects with an outlet area upwards beyond the muffler.

11. Road finisher according to claim 1, wherein outlet areas of the muffler exhaust pipe and the emission pipe are arranged one behind the other in the direction of motion of the road finisher.

12. Road finisher according to claim 1, wherein outlet areas of the muffler exhaust pipe and the emission pipe are directed, with respect to the direction of motion of the road finisher, to the rear or to the front.

13. Road finisher according to claim 1, wherein the emission pipe ends above an operator's place of the road finisher.

* * * * *